US006772861B2

(12) United States Patent
Vignoli

(10) Patent No.: US 6,772,861 B2
(45) Date of Patent: Aug. 10, 2004

(54) LIFT FOR VEHICLES

(75) Inventor: Giuliano Vignoli, Modena (IT)

(73) Assignee: Giuliano S.R.L. (IT)

( * ) Notice: Subject to any disclaimer, the term of this patent is extended or adjusted under 35 U.S.C. 154(b) by 0 days.

(21) Appl. No.: 09/911,222

(22) Filed: Jul. 23, 2001

(65) Prior Publication Data

US 2003/0015376 A1 Jan. 23, 2003

(51) Int. Cl.[7] ..... B66F 7/00

(52) U.S. Cl. ..... 187/213; 187/211; 187/218; 254/122

(58) Field of Search ..... 187/211, 213, 187/218, 221, 253, 266, 269; 254/122, 124, 98

(56) References Cited

U.S. PATENT DOCUMENTS 1,128,626 A * 2/1915 Rikert ..... 187/269
1,840,591 A * 1/1932 Mather ..... 187/211
2,736,104 A * 2/1956 Sherman ..... 187/204
3,702,645 A * 11/1972 Shaw ..... 187/269
4,010,826 A * 3/1977 Jones ..... 187/269
4,109,896 A * 8/1978 Ragen ..... 187/213
4,573,663 A * 3/1986 Nussbaum ..... 254/122

FOREIGN PATENT DOCUMENTS

FR 2653109 A1 * 4/1991 ..... 254/122

* cited by examiner

*Primary Examiner*—Eileen D. Lillis
*Assistant Examiner*—Thuy V. Tran
(74) *Attorney, Agent, or Firm*—Wolf, Greenfield & Sacks, P.C.

(57) ABSTRACT

A lift for vehicles comprises two parallel ramps for loading the vehicles which can be actuated so as to move vertically. The ramps have concurrent ends which are rigidly coupled to the cross-member of a portal-like frame, with the cross-member being actuatable with a vertical translational parallel motion by way of corresponding actuation along a pair of posts. Corresponding grid-like frames, with rods hinged in a scissor-like arrangement for the constant resting of said ramps on a resting surface and/or floor, are provided below each ramp.

6 Claims, 2 Drawing Sheets

LIFT FOR VEHICLES

BACKGROUND OF THE INVENTION

The present invention relates to a lift for vehicles.

Lifts for vehicle substantially comprising two parallel ramps on which the vehicles are positioned for being lifted, inspected and to perform maintenance have long been used in garages.

According to their structure, the auto lifts or hoists are divided into two main categories: in a first oldest one, the ramps are associated and moved vertically by sliding on four posts; in a second more recent one, each ramp has its own lifting frame of the so-called scissor-like type, and such frames are circuitally or mechanically interconnected so as to move in step, maintaining the parallel arrangement of the ramps.

The first type of lift is substantially sturdier and more stable when loaded but is less practical in use and has a greater overall space occupation.

The posts, which are fixed, limit operator access to the vehicle in the regions where the posts are present, and even when the lift is not loaded and is not in use they obstruct the passage of vehicles during movement within the garages in which the lifts are placed.

The second type of lift is less awkward to use and is far more compact than the preceding one, but this is achieved at the cost of generally lower stability when loaded.

The complete absence of supporting posts allows operators to access without problems all the regions of the vehicle placed on the ramps, and when the lifts are not loaded they can rest on the ground so that they are lowered practically retractably into the floor surface; in this way they do not constitute a hindrance for the movements of the vehicles inside garages, since they can be passed over easily and without danger of interference.

Another need which is felt particularly strongly by users of both kinds of the lifts described above is to have resting areas which are safe and stable in their positioning and on which the conventional instruments for reading and precision measurement of vehicle wheel angle parameters, such as toe-ins, camber angles and others, can be placed.

SUMMARY OF THE INVENTION

The aim of the present invention is to eliminate the above-noted drawbacks of the prior art by providing a lift for vehicles whose structure is sturdy and stable when loaded.

Within the scope of this aim, an object of the present invention is to provide a lift for vehicles which allows full access to the vehicle, maintaining a small space occupation and a structure which does not hinder to an unsurmountable extent the possibility to move the vehicles inside the garages.

Another object of the present invention is to provide operators with a lift for vehicles which has adequate supports for the stable and safe resting of precision instruments normally used for measurements and corrections of the trim of vehicles.

This aim and these and other objects which will become better apparent hereinafter, are achieved by a lift for vehicles, comprising two parallel ramps for loading the vehicles which can be actuated so as to move vertically, characterized in that said two ramps have concurrent ends being rigidly coupled to the cross-member of a portal-like frame, said cross-member being actuatable with a vertical translational motion parallel to itself by way of corresponding means along a pair of posts, corresponding grid-like frames, with rods hinged in a scissor-like fashion for the constant resting of the ramps on a floor surface, being provided below each ramp.

BRIEF DESCRIPTION OF THE DRAWINGS

Further characteristics and advantages of the present invention will become better apparent from the description of a preferred embodiment of a lift for vehicles, illustrated only by way of non-limitative example in the accompanying drawings, wherein.

DESCRIPTION OF THE PREFERRED EMBODIMENTS

With reference to the figures, 1 designates a lift for vehicles comprising two parallel ramps 2 onto which the vehicles are loaded and which can be actuated so as to move vertically.

Figure 4:
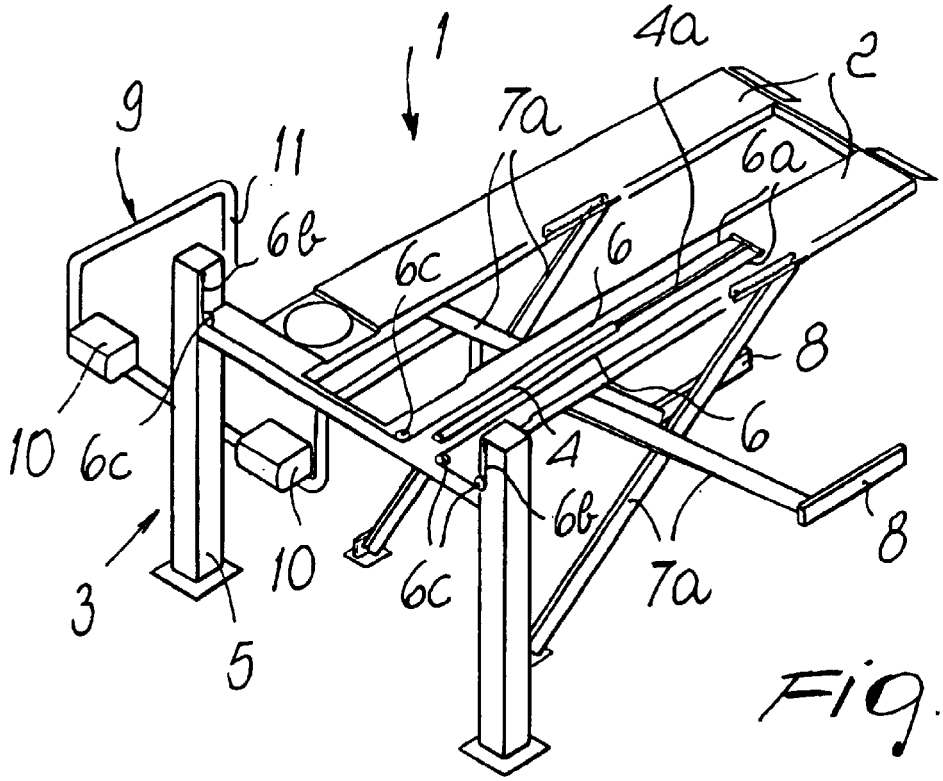
FIG. 4 is a perspective view, in phantom lines, of a possible but not exclusive embodiment of the means for the vertical actuation of the ramps.

The two ramps 2 have, for this purpose, two corresponding ends which are rigidly coupled to the cross-member 3*a* of a portal-like frame 3; the cross-member 3*a* can be actuated with a vertical translational motion parallel to itself by way of corresponding conventional means, constituted for example, as shown in FIG. 4, by a hydraulic or pneumatic actuator 4 which acts by pulling two cable-like traction elements 6 whose respective ends 6*a* and 6*b* are rigidly coupled to the end of the stem 4*a* of said actuator and, after passing around a series of guide pulleys 6*c*, to a pair of posts 5 which compose the frame 3 and along which, as mentioned, the cross-member 3*a* is movable.

In the lower parts of each ramp 2 corresponding grid-like frames 7 are provided which are composed of rods 7*a* being pivoted in a scissor-like fashion for the constant resting of the ramps 2 on a lower supporting surface P, which in the specific case is the floor.

The corresponding lower ends of the rods 7*a* that are directed towards the portal-like frame 3 are articulated in a hinge-like fashion, i.e. with a single degree of freedom, while the opposite ends can slide in or on guides 8 which are substantially horizontal and in the specific case are fixed to said surface P.

On the opposite side of the concurrent ends of the ramps 2 with respect to the portal-like frame 3 a secondary frame 9 is provided for supporting platforms 10 provided for resting instruments for performing diagnostics on vehicles and particularly for checking their trim.

The secondary frame 9 can be rigidly fixed to the posts 5 and to the cross-member 3*a*, and in the latter case can follow its vertical movements: moreover, said secondary frame is of the tubular type and is shaped so as to form two arms 11 for fixing, as mentioned, both to the cross-member 3*a* and to the posts 5, and a cross-member 12 for supporting the resting platforms 10.

The ramps 2 can be provided with supplemental stands 13 which can be pulled out for use or accommodated retractably in each ramp when not in use.

Operation of the invention can be clearly deduced from the above description: a vehicle is placed on the ramps 2 of the lift 1 to be subjected to diagnostic tests by one or more assigned operators.

The extension of the stem 4*a* of the actuator 4 generates on the cable-like traction elements 6 the action for lifting the cross-member 3*a*, which moves with it the ramps 2 and the vehicle arranged thereon.

Beforehand, the operator places the diagnostic instruments, mainly for diagnosing the trim of the vehicle, on the platforms 10, adjusting their alignments on the parts being tested.

Depending on the structure of the instruments and on their consequent operation, the lift 1 can be provided with a secondary frame 9 for supporting the platforms 10 which is rigidly coupled to the posts 5, and is therefore fixed with respect to the vertical movements of the vehicle, or is rigidly coupled to the cross-member 3*a* and therefore movable synchronously therewith.

Figure 1:
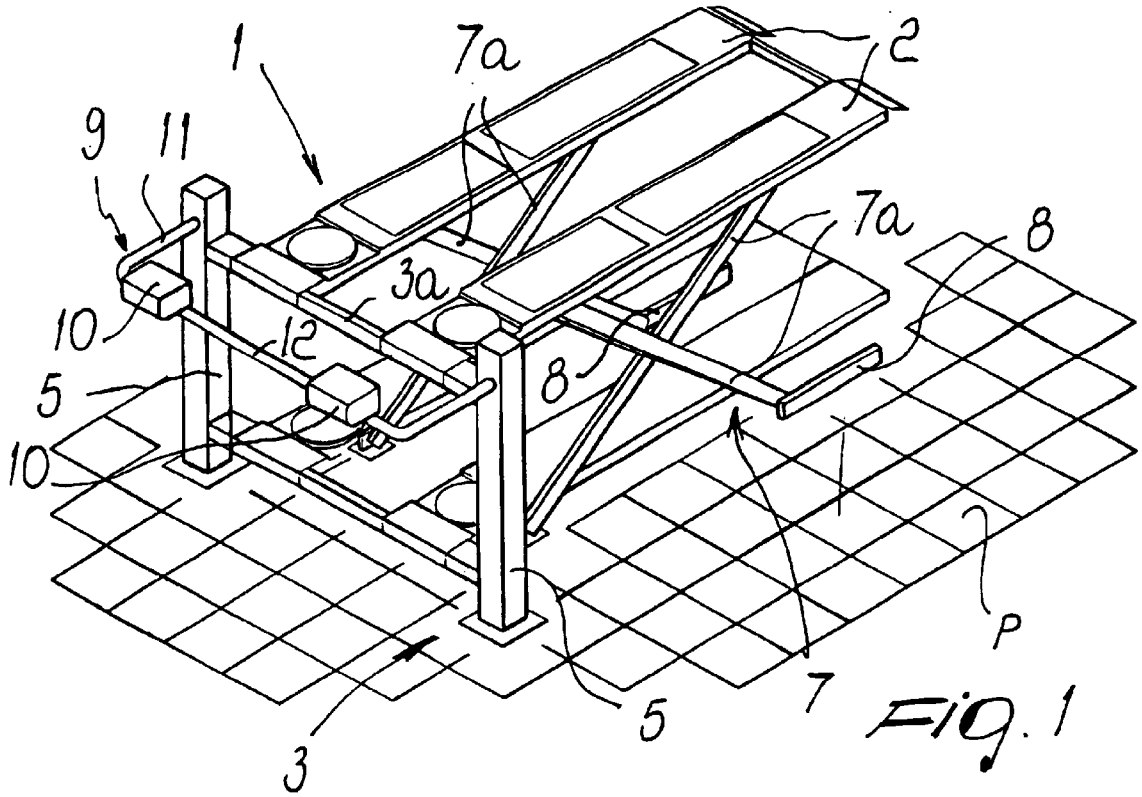
FIG. 1 is a perspective view of the lift for vehicles according to the invention, provided with a secondary frame for supporting instrument-carrying platforms which is associated with the posts.
Figure 2:
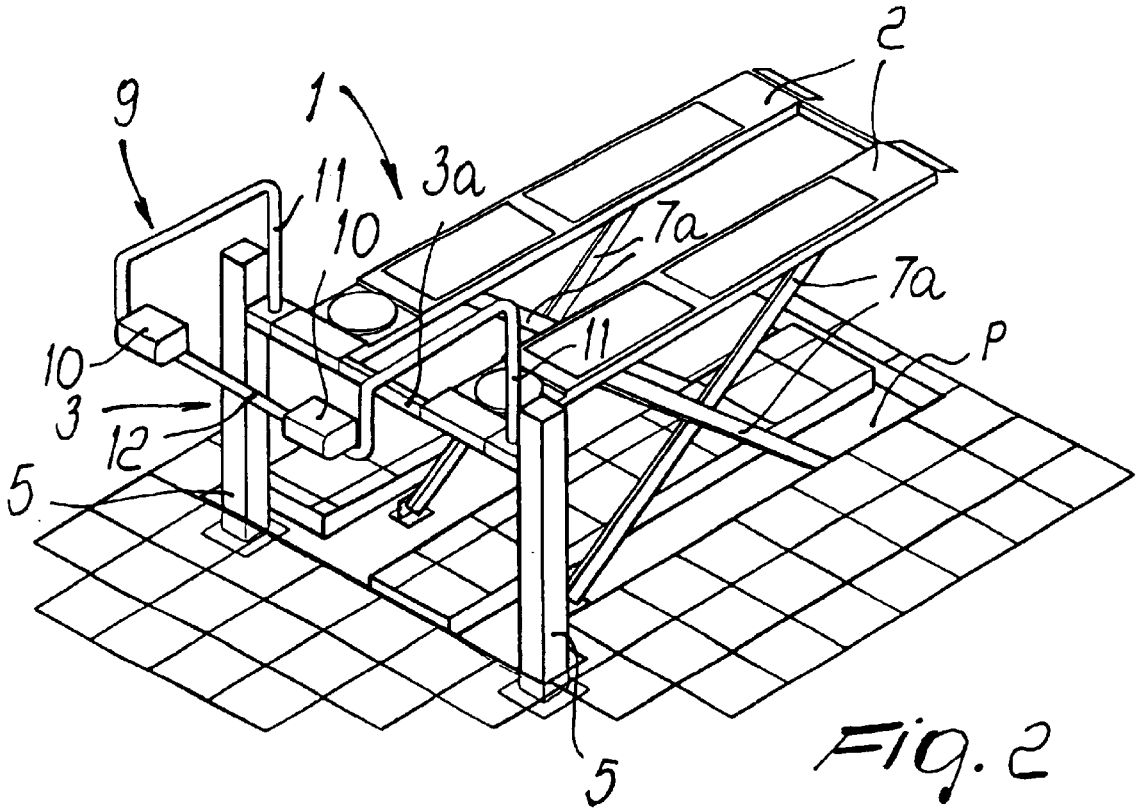
FIG. 2 is another perspective view of a second embodiment of the lift for vehicles according to the invention, in which the secondary frame for supporting instrument-carrying platforms is associated with the movable cross-member of the portal-like frame.
Figure 3:
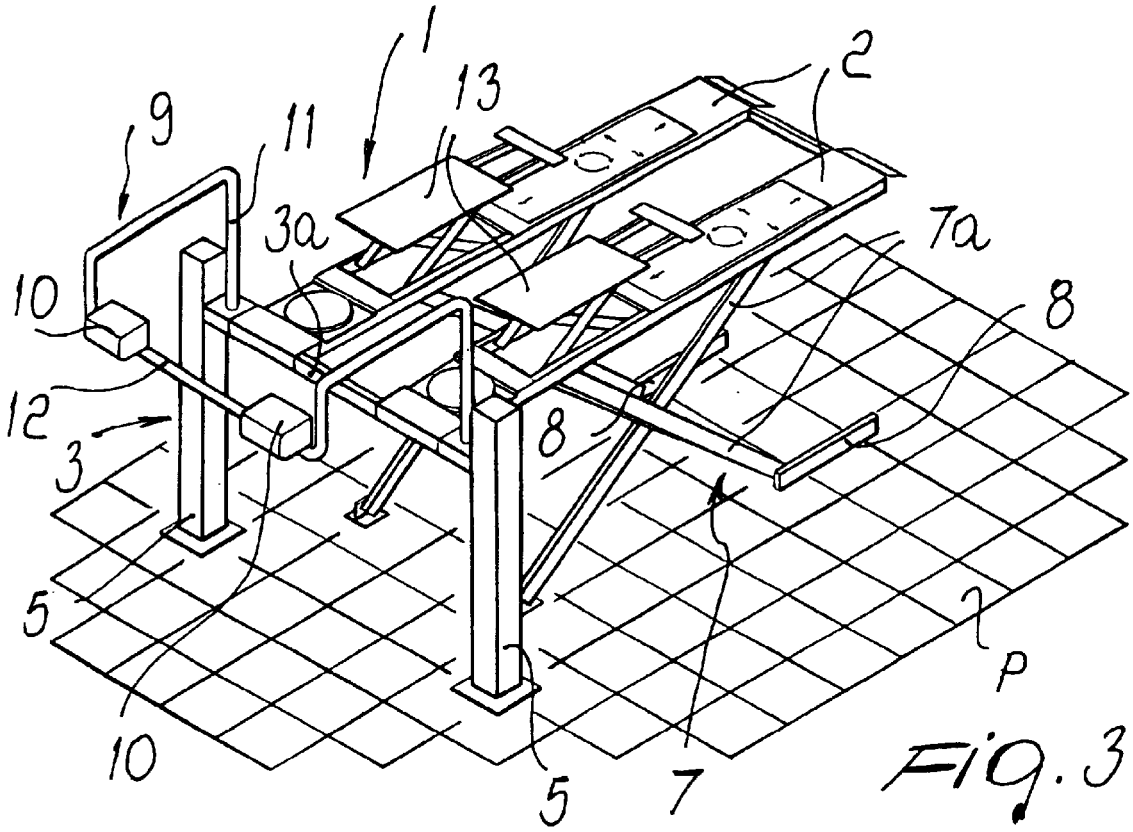
FIG. 3 is a perspective view of the lift for vehicles shown in FIG. 2, in which the vehicle access ramps are provided with pull-out stands.

During the upward translational motions of the ramps 2, the frames 7 provide said ramps with constant support on a surface P, usually constituted by the floor or, as shown in FIG. 2, by suitably provided pits formed in the floor for the retraction of said ramps 2 when they are moved to the fully lowered position.

The rotation of the rods 7*a* and the sliding of their lower ends in the guides 8 allow to follow automatically the movements of the ramps 2, maintaining a constant resting on the surface P and therefore a safe support of the ramps.

When the vehicle is raised, the operator can move around it practically without hindrance and can perform any inspection or intervention that is required in maximum comfort.

When the lift 1 is not in use, the ramps 2, as mentioned, can be lowered so as to retract into suitably provided pits formed in the floor P, or rest on it; in both cases, vehicles can still pass over it, allowing maximum mobility inside the garages in which the lift 1 is installed.

Finally, if necessary the ramps 2 can be equipped with supplemental stands 13 for lifting the body of the vehicles so as to take the load off the wheels.

In practice it has been found that the described invention achieves the intended aim and objects.

The invention thus conceived is susceptible of numerous modifications and variations, all of which are within the scope of the appended claims.

All the details may further be replaced with other technically equivalent ones.

In practice, the materials used, as well as the shapes and the dimensions, may be any according to requirements without thereby abandoning the scope of the protection of the appended claims.

What is claimed is:

1. A lift for vehicles, comprising: two parallel ramps, supported on a resting surface for loading the vehicles, which are actuatable for vertical movement; a portal frame including a cross-member and a pair of posts, said two ramps having concurrent ends being rigidly coupled to said cross-member of the portal-like frame; actuation means for actuating said cross-member for vertical translational parallel motion along said pair of posts; and corresponding grid-like frames provided with rods hinged in a scissor-like arrangement arranged below each one of said ramps for constant resting of the ramps on the resting surface; and supporting platforms for providing support to conventional diagnostic instruments; and a secondary frame arranged on an opposite side of said portal-like frame with respect to the concurrent ends of the ramps.

2. The lift of claim 1, wherein said secondary frame is rigidly fixed to said posts.

3. The lift of claim 1, wherein said secondary frame is rigidly fixed to said cross-member so as to follow the vertical translational motion thereof.

4. The lift of claim 3, wherein said secondary frame is made of tubular elements and comprises two fixing arms and a supporting cross-member for said platforms for supporting diagnostic instruments.

5. The lift of claim 1, further comprising supplemental stands provided at said ramps, said supplemental stands being actuatable for being pulled out for use, and respectively, accommodated retractably in each one of said ramps in an idle state.

6. The lift of claim 1, further comprising horizontal guides, said rods hinged in the scissor-like arrangement having corresponding lower ends thereof that are directed towards said portal-like frame which are pivotally articulated, and further opposite ends which are slideable at said horizontal guides.

* * * * *